United States Patent [19]

Workman

[11] 4,113,001

[45] Sep. 12, 1978

[54] MOULD CLAMPING AND POSITIONING SYSTEM

[76] Inventor: John Workman, Lough House, Greyabbey, County Down, Northern Ireland

[21] Appl. No.: 744,095

[22] Filed: Nov. 22, 1976

[30] Foreign Application Priority Data

Nov. 21, 1975 [GB] United Kingdom ..... 47914/75

[51] Int. Cl.[2] ..... B22D 27/16; B22D 5/02

[52] U.S. Cl. ..... 164/255; 164/327; 164/364

[58] Field of Search ..... 164/364, 365, 374, 375, 164/384–394, 409, 412, 178, 327, 330, 196, 205, 190, 182, 183, 205, 224, 328, 244, 246, 180, 137, 255

[56] References Cited

U.S. PATENT DOCUMENTS

| | | | |
|---|---|---|---|
| 783,577 | 2/1905 | Haggenjos | 164/364 |
| 1,255,466 | 2/1918 | Ryan | 164/190 |
| 2,012,478 | 8/1935 | Oyster et al. | 164/182 |
| 2,085,690 | 6/1937 | Wallace | 164/196 X |
| 2,623,252 | 12/1952 | Miller | 164/205 X |
| 2,726,429 | 12/1955 | Duncan | 164/409 X |
| 3,397,737 | 8/1968 | Tuttle | 164/327 |
| 3,970,139 | 7/1976 | Grolla | 164/385 X |

*Primary Examiner*—Francis S. Husar
*Assistant Examiner*—John S. Brown
*Attorney, Agent, or Firm*—Mason, Fenwick & Lawrence

[57] ABSTRACT

Moulding apparatus comprises a mould box support structure having spaced support members for receiving and supporting lug members formed at opposite ends of a mould box. The mould box is formed in two separable parts each incorporating at opposite ends thereof a lug member having a substantially semi-circular outside profile so that when the mould box parts are abutted the lug members of one box part register with the lug members of the other box part to provide a substantially circular surface which acts as a bearing for the mould box so that the box can be rotated on the support structure for convenience of handling. In one form the mould box is for use with the V-Process of moulding and suction is applied to the chambers within the walls of the mould box parts via conduits extending through the lug members of respective box parts. In one form the support structure includes a circular table which is indexed so that a mould box is sequentially processed through several processing stations.

2 Claims, 11 Drawing Figures

MOULD CLAMPING AND POSITIONING SYSTEM

This invention relates to the casting of metal into moulds.

According to the present invention there is provided moulding apparatus, comprising a mould box support structure incorporating a pair of spaced support members adapted to receive and support opposite ends of a mould box, a mould box formed in two separable parts each said part incorporating at opposite ends thereof a lug member having a substantially semi-circular outside profile, the arrangement being such that when the mould box parts are abutted to form the mould box the lug members of one box part register with the lug members of the other box part so that the substantially semi-circular surfaces of the adjacent lug members co-operate to form a substantially circular surface which is rotatably engageable by said support members.

Preferably the support members each incorporate a part circular surface. Alternatively, the support members may each incorporate a plurality of rollers.

Further, according to the present invention there is provided a mould box part comprising a body portion capable of receiving moulding material, lug members having a substantially semi-circular outside profile secured to said body portion on opposite sides thereof.

An embodiment of the present invention will now be described by way of example with reference to the accompanying drawings, in which.

Figure 1:
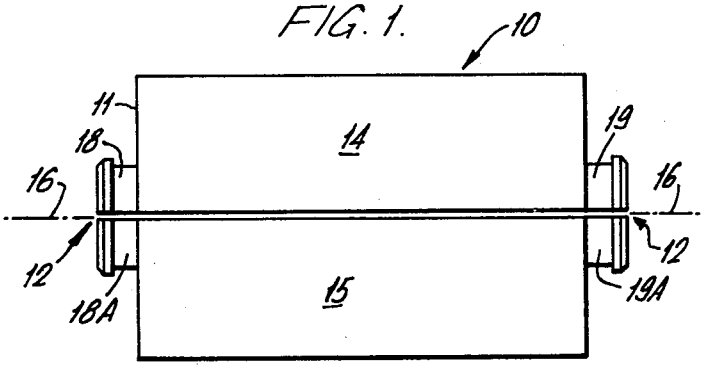
FIGS. 1–4 illustrate the support frame and the mould box as separate components.
Figure 2:
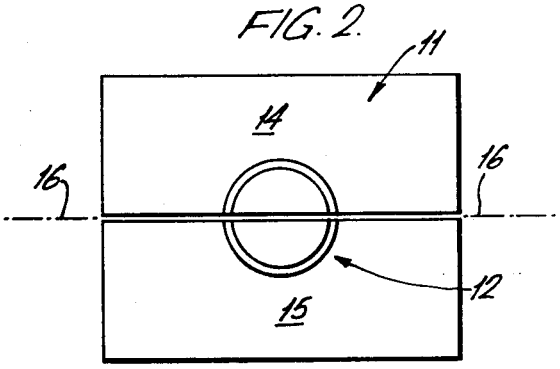
Figure 3:
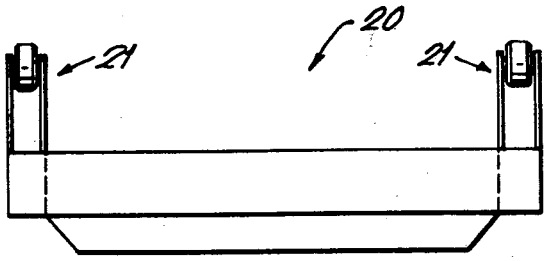
Figure 4:
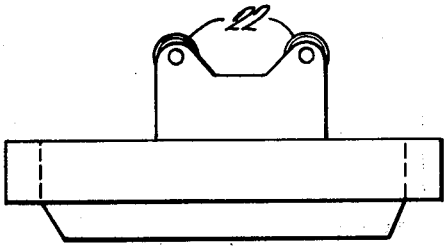

In the drawings a mould box 10 has a rectilinear body portion 11 capable of receiving moulding material such as sand, lugs 12 of substantially circular outside profile being secured to opposite sides of the body portion 11 to permit handling of the box 10. The box 10 is also formed in two halves by abutting parts 14, 15 which abut along a plane 16. The abutting faces of the parts 14, 15 incorporate pins or the like which engage respective recesses to prevent movement of one part 14, 15 relative to the other part. The lugs 12 are formed by lug members 18, 19, 18A, 19A secured to the parts 14, 15 respectively, each lug member being semi-circular in cross-section.

The box 10 is dimensioned to fit freely within a rigid support structure in the form of a frame 20 which has an open central area and which carries a pair of support members 21 at opposite sides thereof for receiving the lugs 12 on rollers 22 which are spaced apart by less than the diameter of each lug 12 so that the box 10 may be supported with the plane 16 either horizontal or vertical, in which latter position the rollers 22 provide a reaction force biassing together the two box parts 14, 15.

Figure 5:
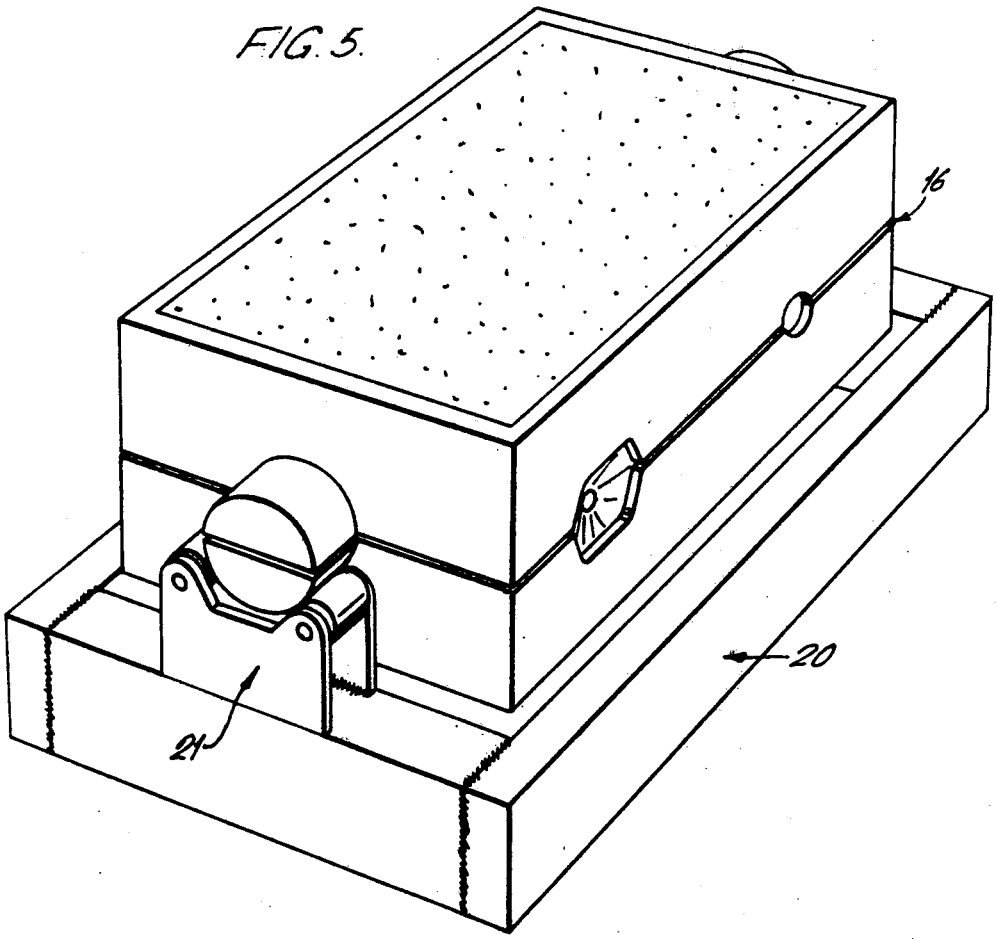
FIGS. 5 and 6 are perspective views of the assembled apparatus.
Figure 6:
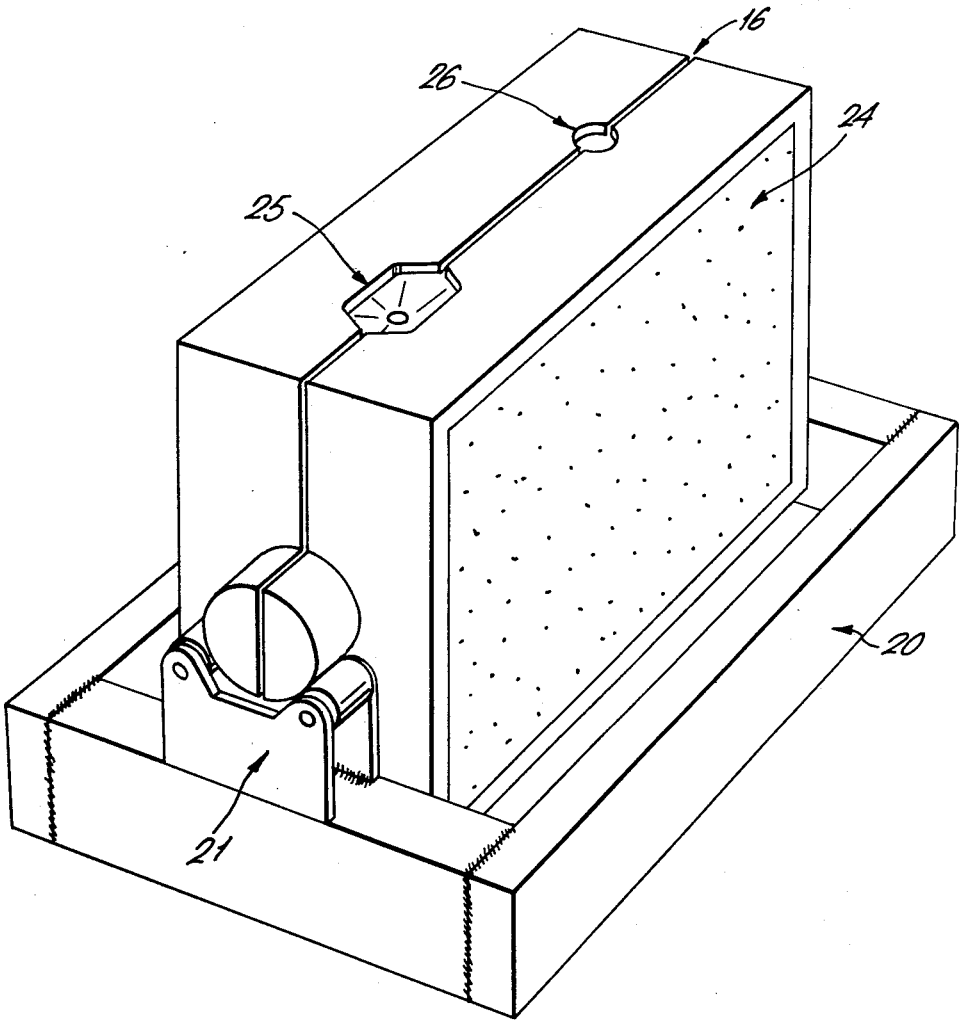

When the apparatus of the present invention is in use each mould box part has a mould formed therein by known foundry methods, the box parts are abutted and mounted on the support frame 20 with the plane 16 horizontal (FIG. 5) to permit ease of handling at this stage (and, if required, the location of metal cores in the lower half of the mould). After the box 10 has been mounted on the frame 20 the box 10 is rotated until the plane 16 is vertical (FIG. 6). As is conventional the mould cavity within the box 10 communicates with a gate bush or aperture 25 and an air vent aperture 26 in the wall of the box 10. Metal is poured into the gate bush 25 with the plane 16 in the vertical position and after casting, the box 10 is retained in this orientation until the casting has solidified. Thereafter the box 10 is rotated to place the plane 16 in the horizontal position, the bottom 24 of the mould box 10 is removed (in known manner) and the casting and moulding material permitted to fall through the open central area of the frame 20.

Figure 7:
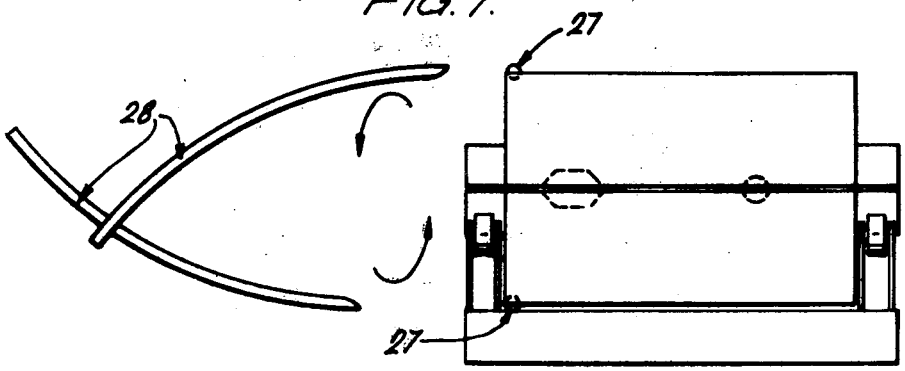
FIG. 7 illustrates a handling arrangement for the apparatus.

The frame 20 may be shaped to be carried by a conveyor means as indicated in FIG. 7, in which case the box 10 may conveniently incorporate projections 27 at its corners for the purpose of engaging fixedly-positioned guides 28 which cause the box 10 to be rotated from its plane-16-horizontal to its plane-16-vertical position and vice versa as the frame 20 is moved past the guides 28.

The support members 21 need not incorporate separate rollers and may incorporate a semi-circular bearing but in this case the members 21 will not exert any force biassing the two parts of the box 10 together. The biassing force of the illustrated embodiment arises from the wedging action between the rollers 22 and the pertaining lug members 18, 18A or 19, 19A and requires to be sufficient to overcome the static head of liquid metal pressure exerted across the joint area tending to force the two parts of the box 10 apart.

Figure 8:
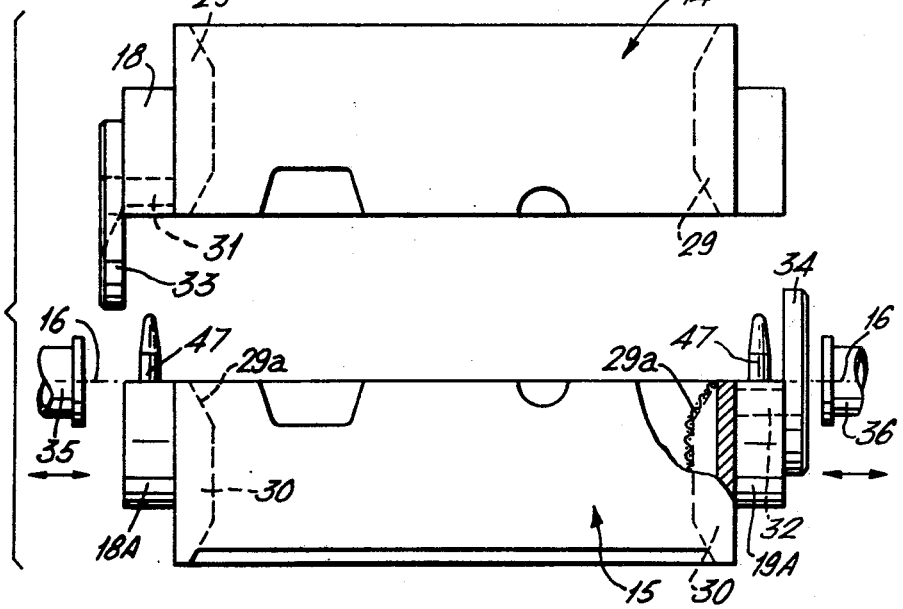
FIG. 8 shows a mould box suitable for use with the V-process.

The above-described apparatus is particularly suitable for use in the vacuum-sealed process of moulding (V-process) wherein sand moulds are formed in mould boxes with the sand grains held together by sub-atmospheric pressure applied to the body of sand grains which is covered at its exposed faces with films of plastics material. For this purpose the mould box parts 14, 15 as shown in FIG. 8, have hollow walls incorporating chambers 29, 30 respectively with screen filters **29*a* at the sand interface. The chamber 29 is connected through a passageway 31 in the lug member 18 to a circular valve plate 35 where the opening is centered on the plane 16. Likewise the chamber 30 is connected through a passageway 32 in the lug member 19A to a circular valve plate 34 where the opening is centered on the plane 16**.

When the two box parts of FIG. 8 are brought together the valve plates 33, 34 at opposite ends of the mould box present the two openings formed by the passageways 31, 32 co-axially and centered on the separation plane 16 which facilitates connection of couplings 35, 36 to the sub-atmospheric pressure system. Because these couplings are on axis the mould box can be rotated easily between the vertical and the horizontal positions and the interface between the couplings and the respective valve plates can act as a seal, or rotary seals (not shown) can be provided in the air lines remote from the mould box. The passageways 31, 32 may each incorporate a non-return valve to enable a moulded sand shape to be maintained without the mould box being continuously connected to the sub-atmospheric pressure system. Also, the couplings 35, 36 may incorporate valves (not shown) which are closed in the absence of a mould box but which open when the couplings 35, 36 are connected to a mould box.

For the purpose of ensuring that the box parts 14, 15 are properly mated to form the completed mould box pins 47 are provided, FIG. 8, in the lug members of part 15 and these are engageable in recesses in the lug members of part 14. Of course, these pins 47 and recesses could be located in other positions.

Figure 9:
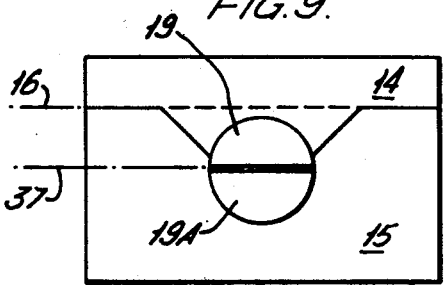
FIG. 9 illustrates a modification of FIG. 8.

FIG. 9 illustrates an embodiment where the two mould box parts 14, 15 are substantially different in thickness so that the joint plane 16 does not coincide with the centre of gravity of the completed box. In this case the lug members 18, 19 are offset from the plane 16 to mate at a plane 37 substantially on the line of the centre of gravity.

Figure 10:
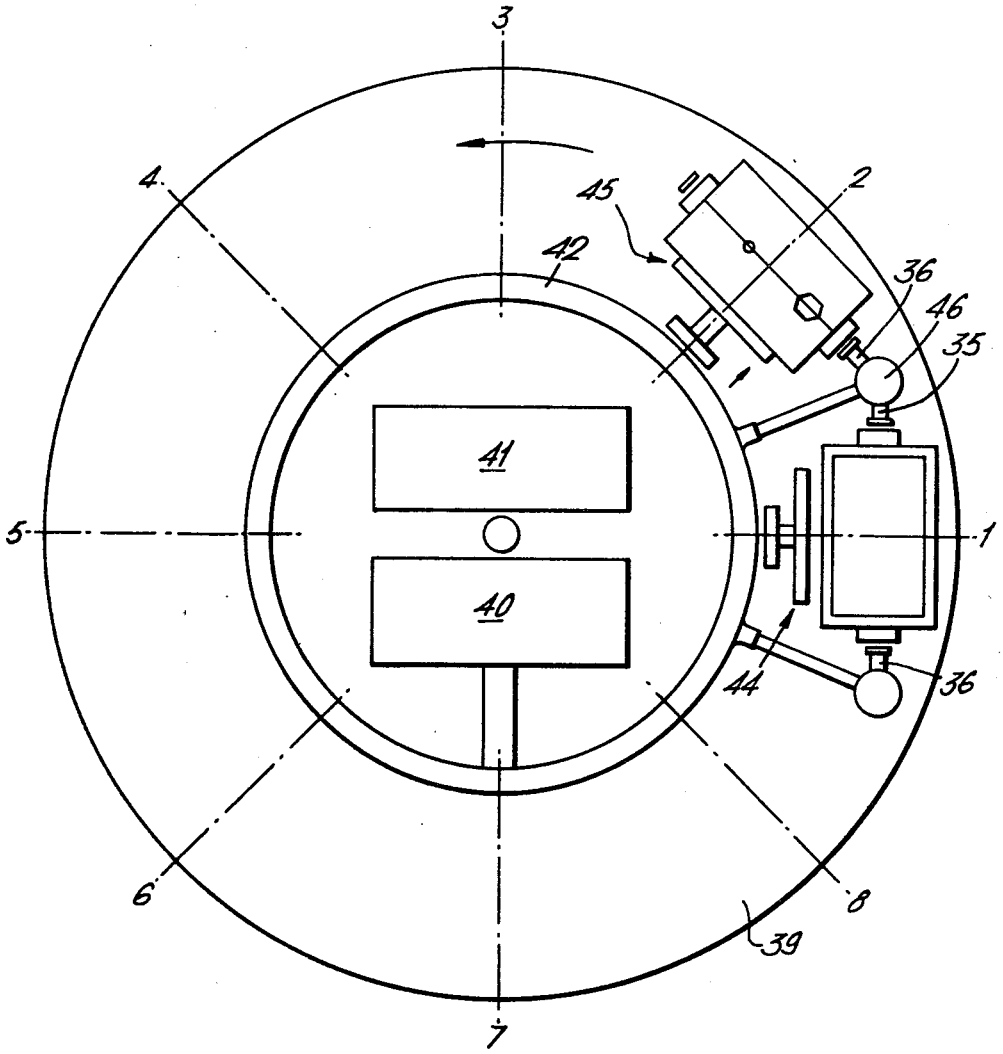
FIG. 10 shows an automated handling arrangement for the apparatus.

For the purposes of automated production in the V-process a support structure as shown in FIG. 10 may be used. The support structure is mounted on a turntable 39 which is rotatably indexed by a motor (not shown) and carries a vacuum pump 40, connected to a ring conduit 42 from which extend radial pipes terminating in headers 46. The couplings 35, 36 are connected to the headers 46. The vacuum pump 40 is driven by a unit 41 which may conveniently be a variable speed electric motor (but any other compact form of prime mover would suffice).

The turntable 39 rotates through eight stations, numbered 1 to 8, and at station 1 the mould box is loaded onto the support structure with the separation plane 16 horizontal. By the time that the turntable 39 reaches station 2 the plane 16 has been rotated so as to be vertical and a planar clamp 44 is urged lightly against the surface of the sand in the cope mould box part so as to co-operate with the bottom of the drag mould box part of FIG. 8. Metal is poured into the mould at station 2 and permitted to cool and solidify at each of stations 3 to 7. At station 8 the clamp 44 is released and the mould box rotated to an inverted position with plane 16 horizontal to permit release of the sand and the cast article into a collection device (not shown).

Although the arrangement of FIG. 8 requires axial movement of the couplings 35, 36 into and out of engagement with the mould box an alternative vacuum connection may be made by other means such as by a pivotal arm with a coupling at one end of a connection to the sub-atmospheric pressure system at the other end, the valve being closed by means of the arm wiping over a closure plate secured to the support member.

Figure 11:
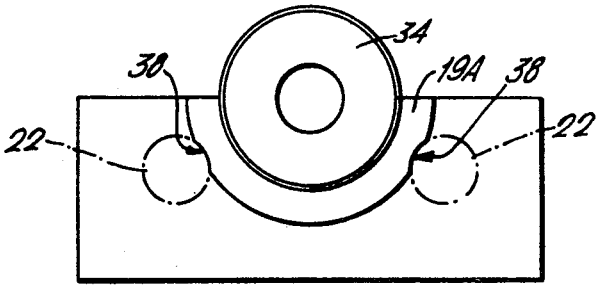
FIG. 11 illustrates a modification of a detail.

Furthermore, although the foregoing description has referred to two lug members 18, 19 as having semi-circular surfaces it is convenient to incorporate indentations 38 as shown in FIG. 11 mating with the two rollers 22 (if such be present) so as to exert a stabilising influence when the completed mould box is mounted on the support structure. Alternatively, the rollers 22 could have a brake for locking purposes, rotation of the mould box being achieved by release of this brake and positive drive being applied by a motor (not shown) or by the arrangement described with reference to FIG. 7.

What is claimed is:

1. Moulding apparatus, comprising:

a mould box formed in two separate parts, the box parts being unitable at a mould parting face and each said part incorporating at opposite ends thereof a lug member having a substantially semi-circular outside profile, the arrangement being such that the mould box parts can be abutted at the mould parting face and the lug members of one box part registered with the lug members of the other box part so that the substantially semi-circular surfaces of the adjacent lug members cooperate to form substantially circular lugs coaxially disposed at opposite ends of the mould box, said mould box also having casting and airventing apertures located in one of the box sides, each of said apertures being intersected by said mould parting face and each being formed partly by each box part, and a mould box support structure incorporating a pair of spaced support members for receiving and supporting said substantially circular lugs of said mould box, each support member having two parallel rollers respectively spaced on opposite sides of the medial plane conjoining said support members, the rollers of each support member being spaced by a distance less than the diameter of the pertaining substantially circular mould box lug, whereby the mould box may be supported on said rollers with the parting face either horizontal or vertical in which latter position the rollers of the mould box support structure provide a reaction force for the weight of the mould box and its contents during casting which biasses the two box parts together.

2. Moulding apparatus as claimed in claim 1, wherein each mould box part is in the form of a frame having an open central area for receiving moulding material and the frame is tubular and defines an annular chamber, and one of said lug members incorporates a passageway one end of which is in communication with said chamber, said lug member terminating in a valve plate at which the other end of the passageway opens co-axially with the centre of curvature of the lug member, the frame wall defining the boundary between the annular chamber and the central area is in the form of a screen filter, and the valve plates of the two box parts being located one at each end of the mould box when the mould box parts are united, and said support structure is mounted on a conveyor means for sequentially indexing the mould box through a plurality of processing stations between adjacent different ones of which the box may be rotated on said support structure, said conveyor means having mounted thereon a source of sub-atmospheric pressure and conduits connecting said source to couplings located adjacent each of said support members for mating with said valve plates and applying sub-atmospheric pressure from said source to the chamber of each box part during said indexing movement.

* * * * *